United States Patent [19]

Wyke

[11] 4,431,532

[45] Feb. 14, 1984

[54] TRANSDUCER AND METHOD FOR PRODUCING WAVE ENERGY

[76] Inventor: Paul R. Wyke, 1819 Kent Des Moines Rd., Des Moines, Wash. 98188

[21] Appl. No.: 384,073

[22] Filed: Jun. 1, 1982

[51] Int. Cl.[3] ..... B03B 5/12; B03B 5/24

[52] U.S. Cl. ..... 209/457; 209/500; 137/624.14

[58] Field of Search ..... 209/500, 501, 455–457; 137/624.14

[56] References Cited

U.S. PATENT DOCUMENTS

| | | | |
|---|---|---|---|
| 2,129,795 | 9/1938 | Storsand | 209/455 |
| 2,242,020 | 5/1941 | Wood | 209/455 |
| 2,246,084 | 6/1941 | Wood | 209/457 |
| 2,781,129 | 2/1957 | Remer | 209/455 |
| 3,087,619 | 4/1963 | Kraut | 209/500 X |
| 3,703,237 | 11/1972 | Cohen-Alloro et al. | 209/500 X |
| 3,972,344 | 8/1976 | Chauvigne | 137/624.14 X |

*Primary Examiner*—Ralph J. Hill

*Attorney, Agent, or Firm*—Joan H. Pauly; Delbert J. Barnard

[57] ABSTRACT

An expansible chamber is expanded to create a partial vacuum within the chamber. Following expansion, a burst of fluid pressure, attended by fluid flow and an acoustical wave, is introduced into the chamber. Simultaneously, the chamber is forcibly contracted. This transducer produces a square acoustical wave. When the transducer is incorporated into the hutch of a mining jig, it results in the pulling of agglomerations of minute particles down out of the gangue and into the hutch chamber. An annular valve member is movable axially towards and away from a valve seat. The valve member includes a concave sealing surface which mates against a convex valve seat having a smaller radius of curvature. Sealing contact is made adjacent the high pressure side of the valve. A gap is created which widens from the zone of contact towards the low pressure side of the valve. When the valve is opened a small amount, a gap is created between the sealing surface and the valve seat which narrows from the high pressure zone to the low pressure zone.

18 Claims, 13 Drawing Figures

6
4
84
22
54
74
40
26
62
72

TRANSDUCER AND METHOD FOR PRODUCING WAVE ENERGY

DESCRIPTION

1. Technical Field

This invention relates to transducers, and more particularly, to a fluid driven transducer that produces positive and negative pressure pulses in a pattern resembling a square wave, and to a method of wave generation and to apparatus utilizing said wave generation method.

2. Background Art

A principal object of the present invention is to provide an improved system of separating saleable concentrate of valuable minerals, such as gold, from the gangue in which the minerals occur. With rare exceptions, commercial recovery of saleable concentrate requires excavating large quantities of gravel and rock for processing to obtain a small amount of valuable mineral. Hand panning, the historical separation method used by individual prospectors, requires careful attention and expert skill to avoid serious losses of valuable minerals even when only small amounts of material are being processed. In the last century, miners turned to other methods to increase their production of valuable minerals, especially gold. These other methods included the use of rocker boxes, long toms, and sluice boxes. Unfortunately, such methods inevitably led to large losses of valuable material that was carried away in the flow of water to the tailing pile. In an effort to avoid such losses, some miners constructed long sluices, with the length of such sluices sometimes exceeding a mile. These long sluices were very expensive to construct and required much attention and a good deal of clean-up labor.

The development of mining jigs provided a more compact and effective alternative. The earliest jigs were little more than a bed suspended on a rope harness and having a bag underneath to catch the minerals. The bed was dipped in and out of a water source, such as a creek. These early jigs were followed by the fixed bed machines that are recognized as jigs today.

The structure of known mining jigs with fixed beds varies considerably. The following is a list of patents that disclose fixed bed mining jig apparatus:

- U.S. Pat. No. 279,641, granted June 19, 1983, to M. B. Dodge;
- U.S. Pat. No. 1,789,516, granted Jan. 20, 1931, to G. C. Crangle;
- U.S. Pat. No. 2,211,068, granted Aug. 13, 1940, to E. P. McDonald;
- U.S. Pat. No. 2,271,650, granted Feb. 3, 1942, to M. Kraut;
- U.S. Pat. No. 2,344,094, granted Mar. 14, 1944, to M. Kraut;
- U.S. Pat. No. 2,847,125, granted Aug. 12, 1958, to H. E. Belliard; and
- U.S. Pat. No. 4,019,981, granted Apr. 26, 1977, to Stern et al.

Each of the above patents discloses a mining jig in which liquid is moved up and down through a fixed bed. All of the jigs disclosed are of limited efficiency, particularly in the ability to recover extremely small particles of the valuable mineral.

The above cited patents, together with the prior art that was cited and considered by the Patent Office before granting them, as listed on such patents, should be carefully considered for the purpose of properly evaluating the subject invention and putting it into proper perspective relative to the prior art.

DISCLOSURE OF THE INVENTION

This invention relates to a novel transducer that is particularly valuable when used in a mining jig of the type having a fixed screen that supports bedding material and material to be worked on. According to a basic aspect of the invention, the transducer comprises wall means that define an expansible hutch chamber at least a portion of which is in use positioned below said screen. This chamber has an outer portion which is movable towards and away from the screen. Return spring means normally bias the outer portion of the chamber inwardly. Outlet means are provided for the chamber, which outlet means include check means for permitting outflow from said chamber when pressure in the chamber exceeds the pressure downstream of the chamber and preventing backflow into the chamber when the pressure in the chamber is lower than the pressure downstream of the chamber. The transducer also includes means for driving the outer portion of the chamber outwardly, to store energy in the return spring means and increase the volume of the chamber. In addition, the transducer includes means for delivering a burst of fluid pressure, attended by fluid flow and an acoustical wave, into the chamber when the chamber is substantially at its maximum size and for removing the outward force on the outer portion of the chamber essentially simultaneously with the introduction of the burst of fluid pressure. This permits the return spring means to move the outer portion of the chamber inwardly towards the screen and return the chamber to its minimum size. The means for delivering and for removing include valve means that opens to deliver the burst of fluid pressure and fluid flow and closes substantially when the hutch chamber reaches its minimum size.

According to another aspect of the invention, the means for delivering a burst of fluid pressure and the means for driving comprise annular wall means that includes a flexible portion and that, with outer portions of the wall means that define the expansible hutch chamber, forms an expansible annular drive chamber surrounding the expansible hutch chamber. The valve means is positioned between the annular drive chamber and the hutch chamber. The means for delivering and the means for driving also include inlet means for introducing fluid under pressure into the drive chamber to expand the drive chamber.

According to another aspect of the invention, the annular wall means has an annular inner portion that extends substantially radially outwardly from the wall means defining the hutch chamber inwardly of said outer portion of the hutch chamber. The annular wall means also has an annular outer portion that extends rigidly and substantially radially outwardly from said wall means defining the hutch chamber adjacent to said outer portion of the hutch chamber. The means for driving the outer portion of the hutch chamber outwardly comprises a pressure surface formed by the annular outer portion of the annular wall means. This pressure surface is acted upon by the fluid under pressure admitted into the annular drive chamber. This fluid exerts an outward force on the wall means defining the hutch chamber via the pressure surface to increase the volume of the hutch chamber.

According to still another aspect of the invention, the wall means defining the hutch chamber includes a first upper portion and a second lower portion that defines said outer portion of the hutch chamber and that is spaced vertically below said first upper portion. This second lower portion includes a vertically flexible wall portion and an upper end wall. The valve means comprises an essentially annular seal that is carried by this upper end wall and that seats against the annular upper portion of the annular wall means.

According to a preferred aspect of the invention, the transducer further includes a frame with a rigid bottom wall and sidewalls that surround the hutch chamber. The spring means comprises at least one leaf spring having a central portion that is urged against a bottom surface of the wall means defining the hutch chamber. Each end of the leaf spring is suspended from an upper portion of the sidewalls of the frame to isolate vibrations originating in the hutch chamber.

When used in a mining jig, the transducer of this invention provides more efficient and complete separation of valuable minerals than can be obtained with known mining jig apparatus. In a jig equipped with a transducer of the invention, particles too small to be seen tend to aggregate together and are separated effectively from the gangue in which they occur. Known mining jig apparatus cannot efficiently separate out such small particles. The burst of fluid pressure that is characteristic of the transducer of this invention puts the small particles into motion so that they can agglomerate. Known mining jigs lack this burst of fluid pressure and thus are unable to impart sufficient momentum to the very small particles. When the valve means of the transducer closes, fluid flow into the hutch chamber is cut off, creating a negative fluid pressure that pulls the agglomerations of minute particles down out of the gangue and into the hutch chamber. This negative fluid pressure does not create the problem found in known mining jigs of producing unacceptable compaction of the bedding and working material because the positive burst of fluid pressure prevents compaction from being a problem.

The transducer of the present invention has additional advantages when used in a mining jig. For example, the transducer is very energy efficient since it is powered simply by water pressure. In many mining locations, the water pressure is naturally available, such as from a waterfall or upstream flow. In addition, when water in large quantities is not readily available, the transducer may be operated in a closed system. That is, the water flowing out of the hutch chamber through the outlet means may be recycled and used to create the burst of fluid pressure attended by fluid flow into the chamber.

When used with a mining jig, the transducer of this invention also provides more efficient and complete separation of larger particles of valuable minerals. In spite of its greater effectiveness, the transducer is inexpensive to initially purchase and very inexpensive to maintain. Thus, superior performance is attained in both cleaning and roughing and, at the same time, the expense of operation is decreased.

As previously indicated, the transducer is believed to have general application. In some other installations, the wave energy that is generated would be delivered from the transducer into an adjoining region, to perform such work as pumping, distance measuring, fluidizing, etc.

Thus, one aspect of the invention is to provide a method of generating wave energy. In accordance with such method, an expansible chamber is expanded and in so doing the pressure within the chamber is reduced. Following expansion of the expansible chamber a predetermined amount, a burst of fluid pressure, attended by fluid flow and an acoustical wave, is delivered into the expansible chamber. Substantially simultaneously with the introduction of the burst of fluid pressure into the expansible chamber, the expansible chamber is forcibly contracted, with the expansible chamber in open communication with an adjoining region.

Another important aspect of the invention is to provide a valve for use between a high pressure first chamber and a low pressure second chamber. The valve comprises means defining an annular valve seat. A valve member is movable axially towards and away from the valve seat. The valve member includes an annular sealing surface. Either the valve seat or the sealing surface is convex in the axial direction and the other is concave. The curvature of the valve seat differs from the curvature of the sealing surface such that when the valve member is seated an annular zone of contact exists between the sealing surface and the valve seat and an annular gap exists between the valve seat and the sealing surface on the lower pressure side of the valve. The gap widens from the region of sealing contact towards the low pressure chamber when the valve member is seated. However, after the valve member has moved axially away from the valve seat a predetermined amount, a gap is formed between the sealing surface and the valve seat which narrows from the high pressure chamber to the low pressure chamber. As a result of this construction, the valve is substantially self-sealing if a leak tends to occur between the valve member and the valve seat. Yet, upon opening of the valve a small amount, e.g. 1/32 inch, positive pressure in the gap functions to wedge the two surfaces apart, moving the movable valve member away from the valve seat.

In a preferred embodiment, the valve seat is convex, the sealing surface is concave and the radius of curvature of the sealing surface is larger than the radius curvature of the valve seat.

These and other aspects, features, and advantages will become apparent from the detailed description of the best modes for carrying out the invention and the appended claims that follow.

BRIEF DESCRIPTION OF THE DRAWINGS

In the drawings, like reference numerals denote corresponding parts throughout the several views, and.

BEST MODES FOR CARRYING OUT THE INVENTION

The drawings show a fixed screen, fixed bed mining jig 2 that incorporates a transducer that is constructed according to the invention and that also constitutes the best modes of the invention currently known to the applicant. The jig 2 is designed principally to recover valuable minerals from the gangue in which the minerals occur. The jig 2 includes certain standard features, such as the grate 4 and the screen 6 that are received into a top portion of the jig 2 in a fixed horizontal position. The ragging is supported by the grate 4 and the screen 6, and may take any of a variety of conventional forms. One such form is one-quarter inch minus steel balls 8.

Figure 3:
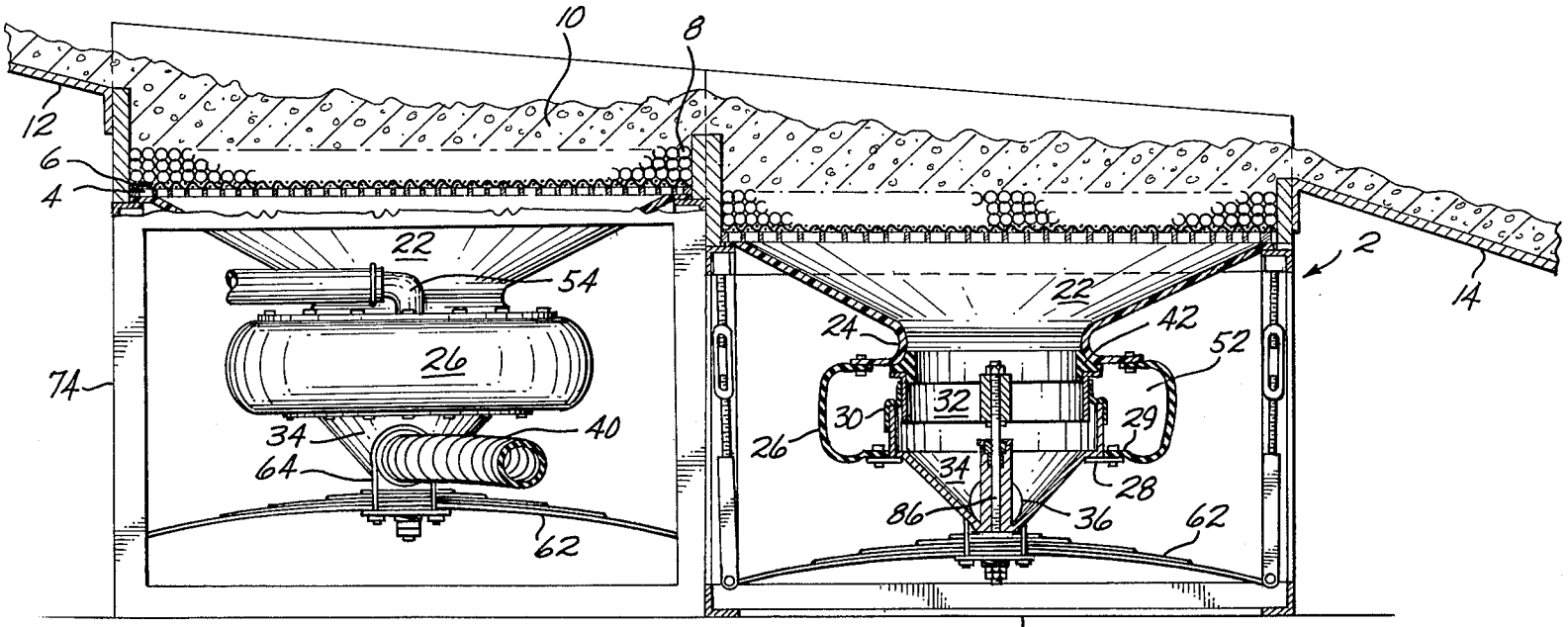
FIG. 3 is a view of two mining jigs in tandum, taken at a right angle to the view of FIG. 2, showing some parts in side elevation and other parts in vertical section, and showing the drive chamber of the jig on the right partially expanded and its return springs partially deflected.

The incoming material 10 to be worked on may be fed into the top of the jig 2 above the ragging by distributing it through a chute. In general, the material 10 to be worked on is diluted with water at a dilution rate of approximately 3 to 1 or less by volume. The incoming chute may include a gate. A chute 14 may also be provided on the outgoing end of the jig 2. As shown in FIG. 3, mining jigs with transducers constructed according to the invention may be operated in series. The mining jig 2 may also be used with various other additional features, such as a crusher circuit which is recommended for hard rock.

In the preferred construction shown in the drawings, the entire hutch is located below the fixed screen 6. Although it is essential that at least a portion of the hutch be so positioned below the screen 6, the shape of the hutch may be varied considerably, including by extending portions of it above the level of the screen 6.

As shown in the drawings, the hutch has several wall portions, all of which corporate to form an expansible hutch. The uppermost such wall portion takes the form of a frusto-conical hopper 22 extending downwardly and inwardly from the outer edges of the screen 6. Moving vertically downwardly, the next wall portion is an annular segment 24 formed integrally with the hopper 22 and curving around and outwardly from the longitudinal center of the hopper 22. This integral annular wall portion is connected at its outer edge to a flexible diaphragm 26. This diaphragm 26 is also annular and has cross sections that are essentially C-shaped. The lower, basically horizontal, section of this annular diaphragm 26 is connected to a rigid annular wall portion 28 that extends horizontally outwardly from the wall that forms the lower portion of the hutch. The lower portion of the hutch is physically separate from the upper hopper portion of the hutch, except that the two are connected by the above described annular diaphragm 26.

The lower portion of the hutch includes an annular vertically flexible wall portion 30 that permits the lower portion of the hutch to expand and contract in volume. One end of this annular flexible wall portion 30 is connected to an upper annular seal carrying wall portion 32, to be described below. The other end of the flexible wall portion 30 is connected to the upper circumference of the walls forming the lowest portion 34 of the hutch.

The walls forming the lowest portion 34 of the hutch are preferably formed as an integral body. The walls of this body 34 are circular at the top of the body 34 and extend vertically downwardly and then horizontally inwardly for a distance sufficient to allow the attachment of the rigid horizontal wall 28 to which the lower end of the flexible diaphragm 26 is attached. The walls then essentially extend downwardly and inwardly to form a frustoconical portion. The shape of this frustoconical portion is interrupted by two horizontal cylindrical conduits 36 extending outwardly from the frustoconical body. These two conduits 36 are essentially diametrically opposed. These conduits 36 provide the outlet means for the hutch.

The annular seal carrying body 32 has a diameter that is less than the upper diameter of the lowest portion 34 of the hutch. Thus, when the volume of the hutch decreases, the seal carrying portion 32 folds down into the lowest portion 34. The seal carrying body 32 has an upper end wall 38 that carries an annular seal 42. This annular seal 42 seats against the annular wall 24 that curves and extends outwardly from the bottom of the hopper portion 22.

When the seal 42 is seated, the hopper portion 22, the seal carrying body 32, and the lowest portion 34 form the hutch of the jig 2. The annular walls 24, 28 extending outwardly from the hopper 22 and from the lowest portion 34, together with the flexible diaphragm 26 and outer portions of the walls of the lower expansible portions of the hutch, form an annular expansible drive chamber 50.

The transducer is provided with spring means 62 to normally bias the lowest portion 34 of the hutch in an upper collapsed position in which the volume of the hutch is at a minimum. Of course various kinds of springs could be used, but in the preferred embodiments the spring biasing is provided by two leaf springs 62. Each of these leaf springs 62 has an upper horizontal central portion that is urged against a bottom surface of the hutch. The conduits 36 that provide the openings for the outlet means for the jig 2 also function to provide a convenient means of mounting the springs 62.

In the preferred embodiment, the transducer is mounted on a frame that has a rigid bottom 72 that provides it with a firm and level base. The frame also has side members 74. As shown in the drawings, there are four side members 74 in the preferred embodiment forming a rectangular frame. The side members 74 are connected at the top to provide the necessary rigidity and strength to the frame. Each end of each of the leaf springs 62 is suspended from an upper portion of one of the sidewall members 74. Various means of suspending the springs 62 may be used, such as that disclosed in the drawings. Each suspending means is attached at the top to the upper portion of one of the sidewall member 74 and at the bottom to one end of one of the springs 62. The spring 62 is not attached to any other portion of the frame. The central portion of each spring 62 is secured to one of the conduits 36 at the bottom of the hutch by two U-bolts 64 to maintain the spring 62 in the proper position in relation to the hutch. Suspending the springs 62 from the upper portion of the frame, which is just below the grate 4 and screen 6, functions to isolate the vibrations originating in the hutch. This helps to stabilize the mining jig 2 and to prevent two jigs from interfering with each other when they are placed in series as shown in FIG. 3.

The transducer of the invention is provided with means for forcing the lowermost portion 34 of the hutch downwardly, to compress the leaf springs 62 and increase the volume of the hutch. This forcing means includes an essentially horizontal pressure surface 29 that is formed by the annular wall portion 28 that projects outwardly from the lowest body portion 34 of the hutch. This pressure surface 29 faces inwardly into the annular drive chamber 52. When fluid under pressure, in the operation of a mining jig usually water under pressure, is admitted into the drive chamber 52, such fluid exerts a downward force on the lowest body portion 34 of the hutch via the pressure surface 29. The downward force moves the lowest body portion 34 of the hutch downwardly, increasing the volume of the hutch. The fluid under pressure is admitted through the inlet 54 shown in the drawings. It should be noted that the drawings show one such inlet 54. However, a mining jig incorporating the transducer of the present invention may include more than one such inlet, although only one inlet may be necessary at a given time. The plurality of inlets would simply provide convenience should it be desired to introduce the inlet water from different directions.

The inlet water may be obtained from a variety of sources. In many mining settings, water is naturally available from sources such as water piped from an upstream location, a dam, or a waterfall. Of course, water should be screened free of foreign particles before being introduced into the system. The transducer is designed to operate under water pressure equal to about fifty feet head of water. A minimum head is about thirty-five feet. In locations where a natural head of water is not available, a portable pump should generally be used.

The hutch is also provided with outlet means to allow outflow of the water carrying the valuable minerals that have been separated from the gangue. The outlet means includes an opening on the end of each of the conduits 36 at the bottom of the hutch described above. Under normal operating conditions, only one of these openings would be used at a single time, with the other such opening being sealed off. Two openings and two conduits 36 are provided to balance the hutch, for convenience so that the outflow may be provided in either of two opposite directions, and to provide a convenient means for mounting the leaf springs 62 onto the hutch. Any standard flexible tubing 40 may be attached to the conduit 36 which is in use to provide an outflow passageway.

Figure 1:
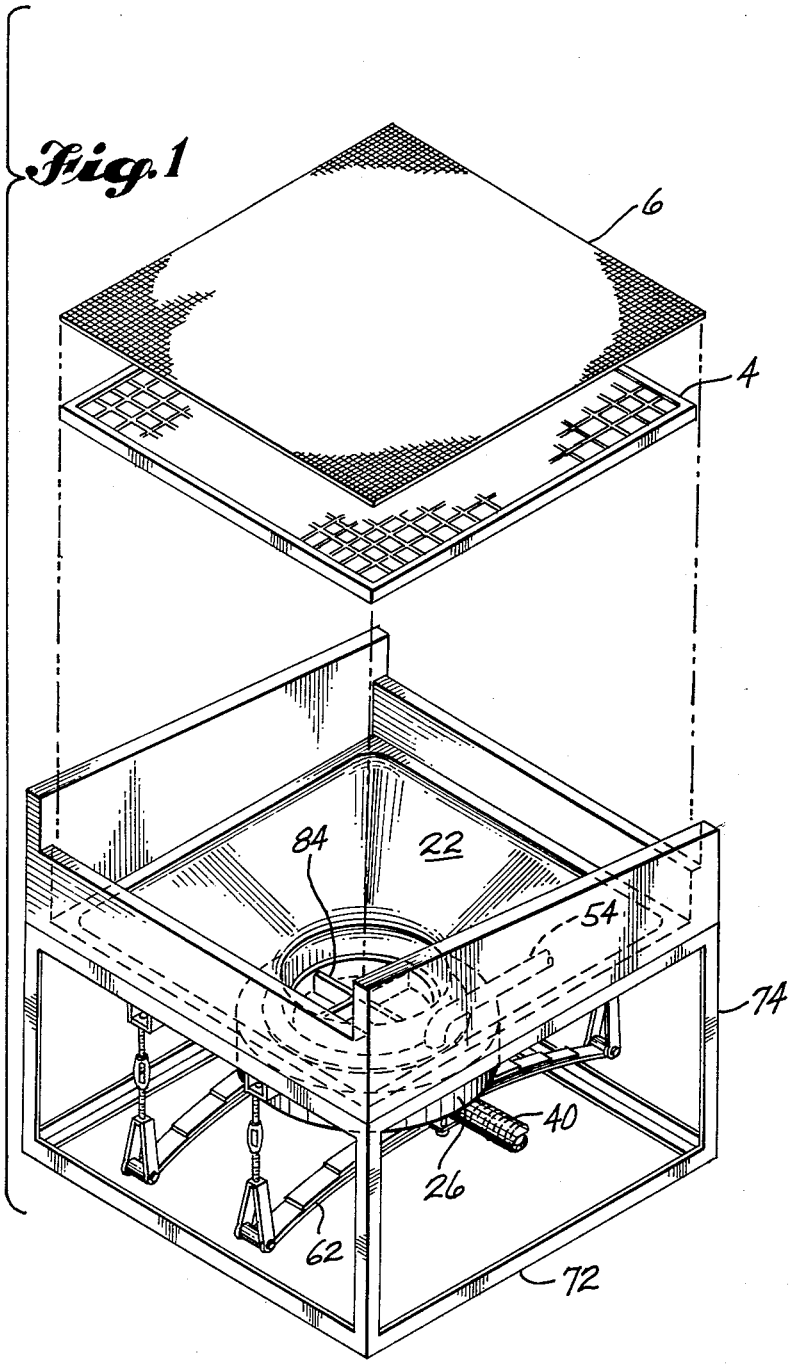
FIG. 1 is an isometric view of a mining jig incorporating the present invention, taken from above and looking toward one side and one end, with bed supporting screen members shown exploded up from their normal positions within the jig, for clarity of illustration of structure is below such screen members.
Figure 2:
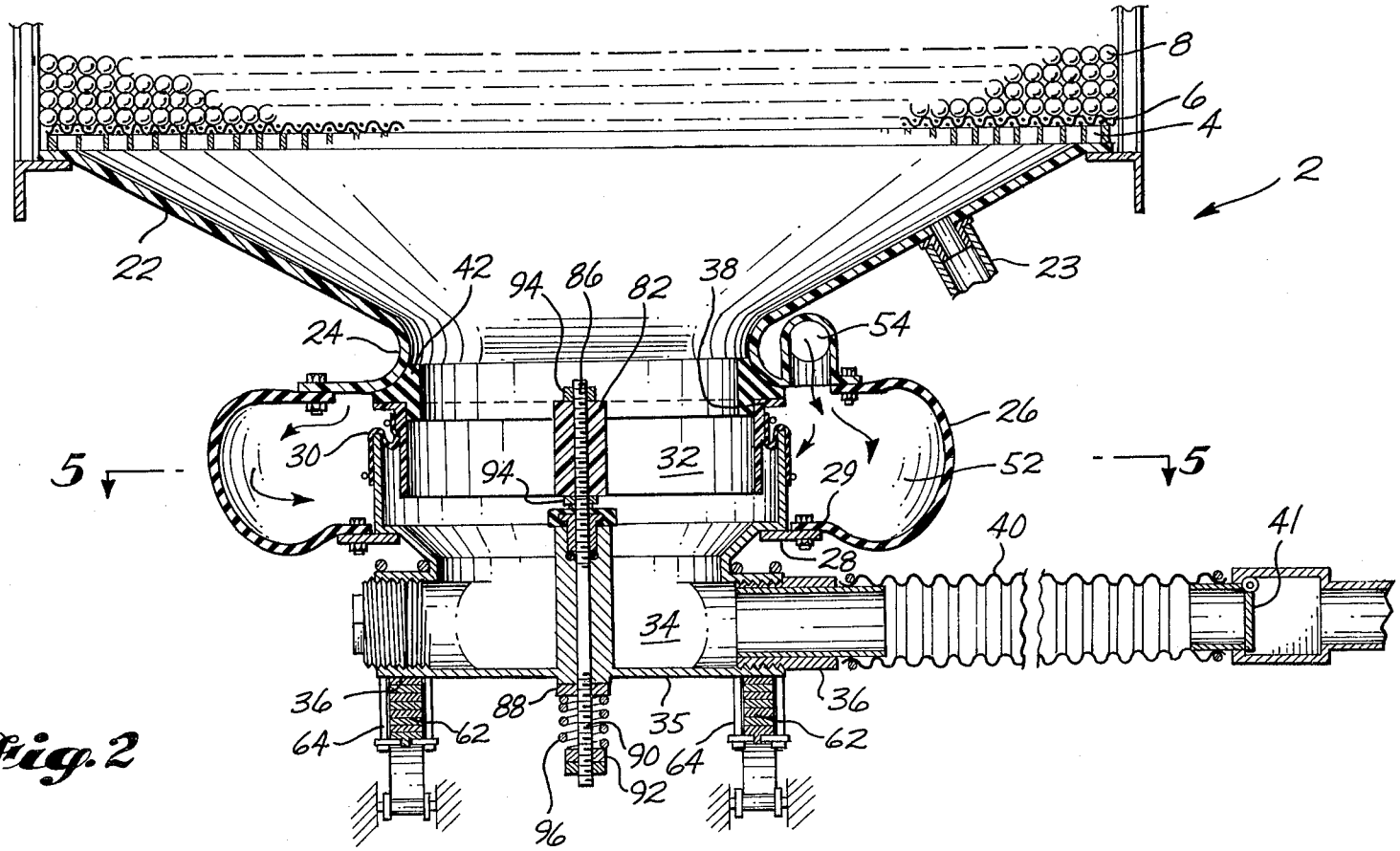
FIG. 2 is an enlarged scale vertical sectional view through the bed and the transducer structure below the bed, said view showing the expansible hutch in its minimum size up position, and showing fluid introduction into the drive chamber.
Figure 4:
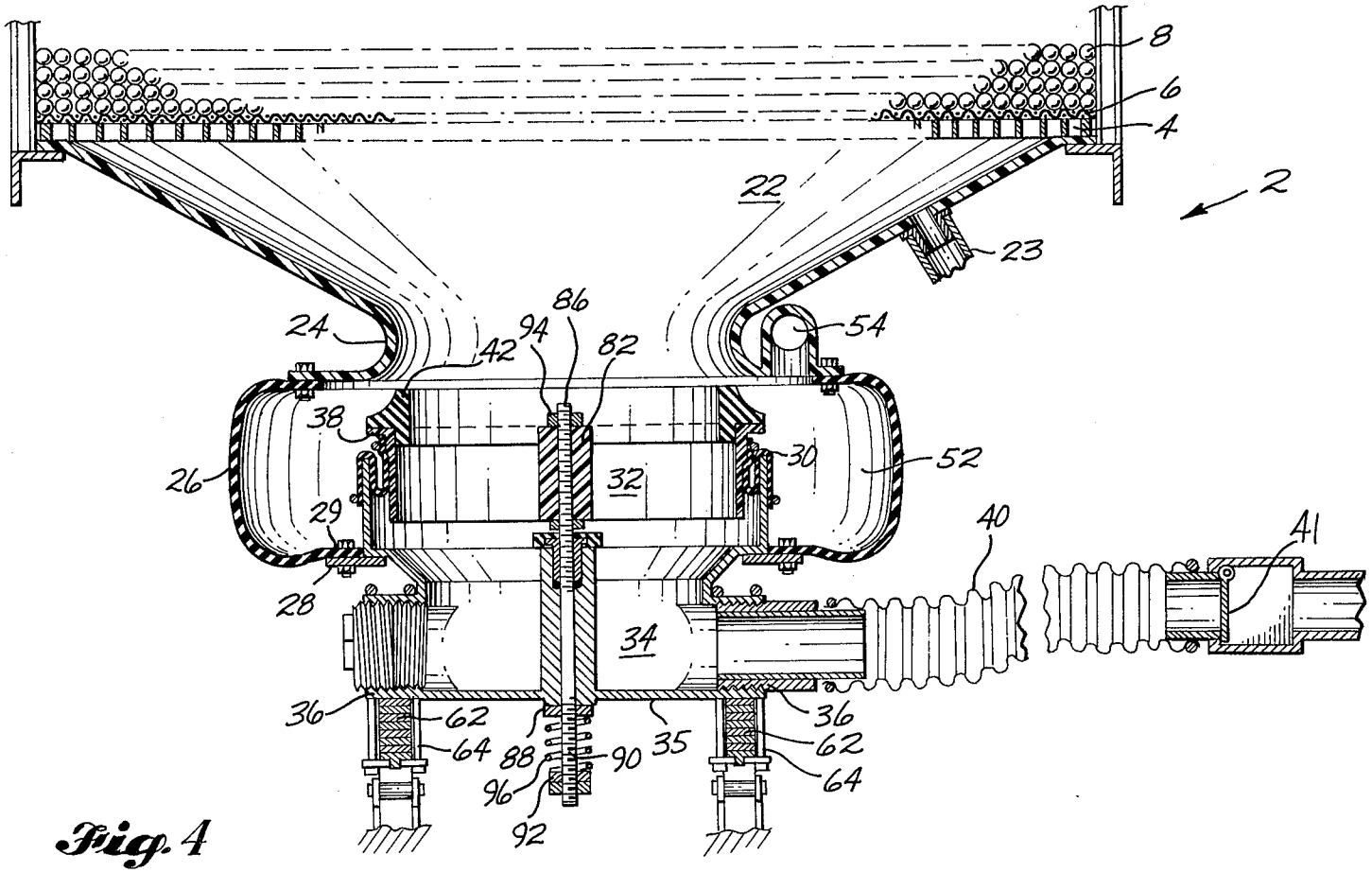
FIG. 4 is a view like FIG. 2, substantially immediately following an opening of the drive chamber valve, showing the position of the parts.
Figure 5:
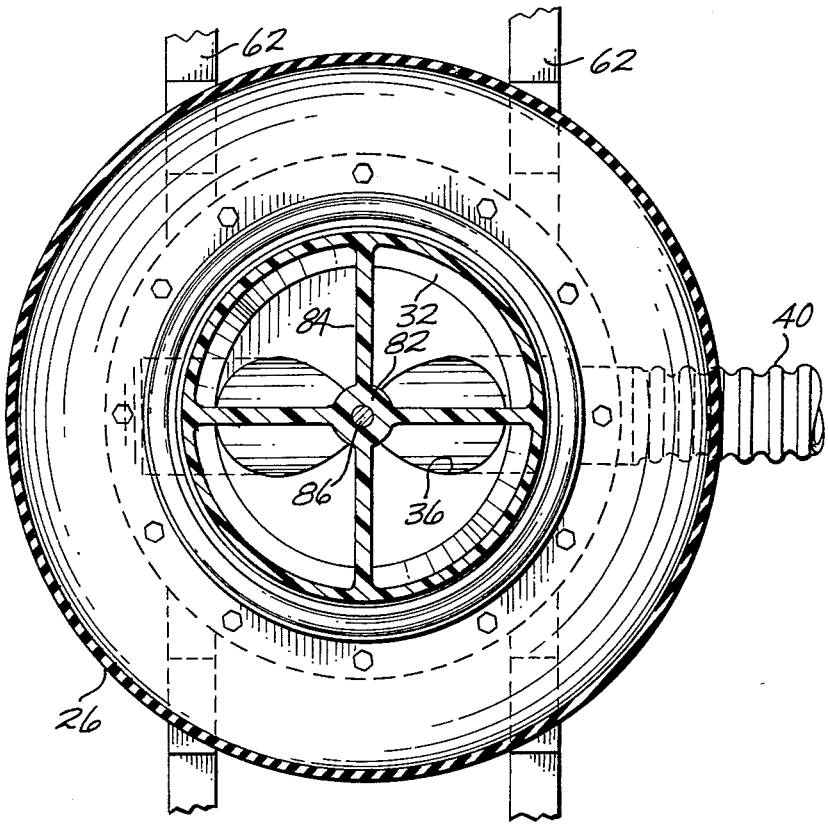
FIG. 5 is a cross-sectional view taken substantially along line 5—5 of FIG. 2.

The outflow of the water carrying the previous minerals is desirable and necessary to the efficient functioning of the jig 2, however, backflow into the hutch through the outflow conduit 36 would interfere with the proper functioning of the transducer. Therefore, means are provided for permitting the desired outflow when the pressure in the hutch exceeds the pressure downstream of the hutch but for checking and preventing backflow into the hutch when the fluid pressure in the hutch is lower than the pressure downstream of the hutch. The undesired backflow may be checked by a variety of means. One such means is the standard check valve 41 shown in FIGS. 2 and 4. As can be seen in those figures, the check valve 41 can be conveniently positioned to control the outlet passageway formed by the tubing 40.

In open systems, that is when the outlet water is not recycled into the drive chamber 52, it is preferable to add an eductor to the outlet tubing 40. The eductor would inject a pressurized stream of water into the tubing 40 in a downstream direction. This would tend to draw flow out of the hutch and to prevent backflow.

In the operation of the mining jig 2, water under pressure is continually admitted into the drive chamber 52 through the inlet 54, which may take any of the standard forms for water inlets. When the annular seal 42 is seated, the water entering the drive chamber 52 exerts a downward force on the lowest body portion 34 of the hutch via the pressure surface 29, as described above. This moves the lowest portion 34 of the hutch downwardly, but the seal carrying body 32 remains in its upper seated position. Thus, while the volume of the hutch is increasing, communication between the hutch and the drive chamber 52 remains blocked by the seal 42. When the hutch has reached its maximum volume, the annular seal 42 is unseated. When the seal 42 unseats, a burst of fluid pressure is delivered into the hutch. This burst of fluid pressure is attended by a flow of fluid, that is, a flow of water and an acoustical wave. Substantially simultaneously with the delivery of the burst of fluid pressure, the downward force on the lowest portion 34 of the hutch is removed. The removal of the downward force permits the leaf springs 62 to move the lowest portion 34 of the hutch upwardly towards the screen 6, discharging the drive chamber 52 and returning the hutch and the drive chamber 52 to their minimum sizes. During essentially all of the upward movement of the lowest portion 34 of the hutch, the lowest portion 34 of the hutch is moving relative to the seal carrying, or valve body. The annular seal 42 is seated to close the valve and close off communication between the drive chamber 52 and the hutch substantially when the hutch reaches its minimum size. When the valve closes, the cycle begins anew, with the water entering the drive chamber 52, building up fluid pressure in the drive chamber 52, expanding the drive chamber 52, and exerting a downward force on the lowest portion 34 of the hutch.

Figure 9:
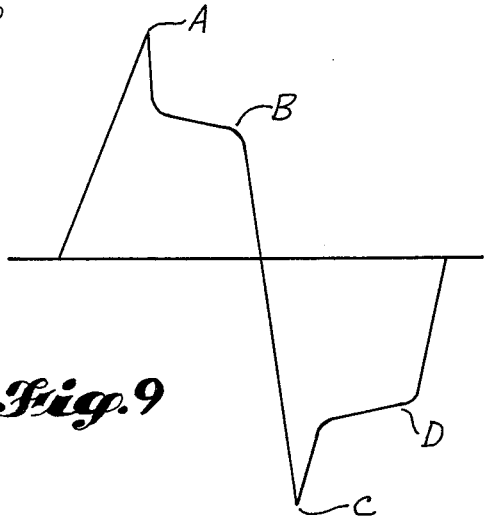
FIG. 9 is a graph of the acoustical wave that is generated during operation of the transducer, showing a single cycle.
Figure 13:
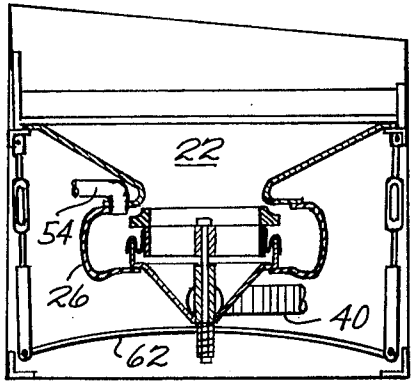
FIGS. 10–13 are sequence of operation views, with FIG. 10 showing the expansible hutch in a minimum size condition, at the start of a cycle, the chamber valve closed, and the start of fluid introduction into the drive chamber, with FIG. 11 showing some expansion of the hutchs caused by fluid pressure within the drive chamber, and showing the drive springs deflected, with FIG. 11 showing the hutch in its maximum size condition, and the drive chamber valve open, and with FIG. 13 showing the return springs functioning to return the expansible chamber and the drive chamber valve to a start position.
Figure 12:
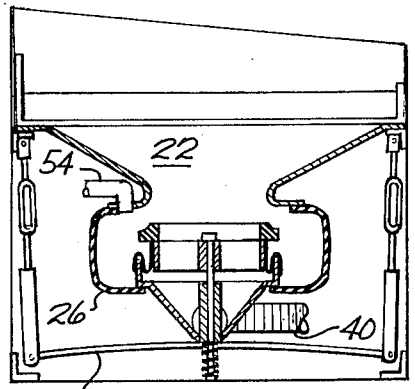
Figure 11:
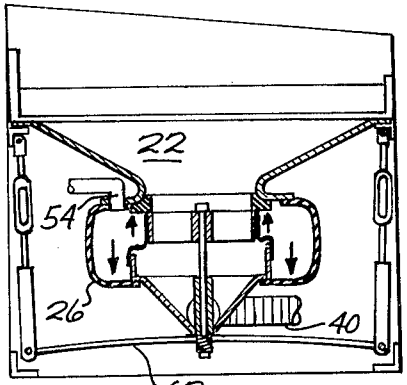
Figure 10:
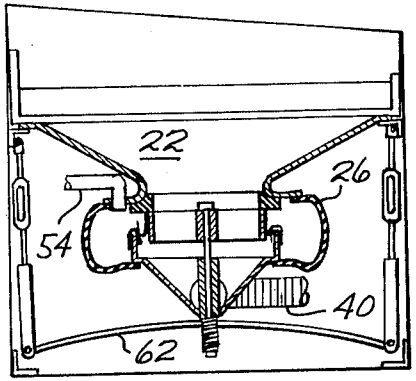

FIG. 9 is a plot of the fluid pressure in the hutch, with the amplitude of the waves of fluid pressure being plotted against time. It should be clear from FIg. 9, that the changes in fluid pressure produce an accoustical wave. In FIG. 9, the peak of the positive pulse of the wave is indicated by A. The positive pulse that reaches its peak at A is almost instantaneous and occurs when the annular seal 42 is unseated to admit a burst of fluid pressure into the hutch. Following this burst of pressure, a positive pulse of fluid pressure that is fairly constant continues to move through the hutch with the flow of inlet water into the hutch. This fairly constant positive pulse is indicated as B on the curve in FIG. 9. The period of this positive pulse corresponds to the time during which the volumes of the hutch and the drive chamber 52 are decreasing but in which the seal 42 remains unseated. At the moment that the seal 42 is unseated, the source of the positive fluid pressure into the hutch is cut off, and there is a sharp negative pulse, due to discharge flow inertia and indicated by C, when the valve closes. D indicates the last portion o the curve which is a fairly steady negative pulse following the sharp negative pulse. The time during which this fairly steady negative pulse occurs corresponds to the time during which fluid pressure is building up in the drive chamber 52 and is moving the lowest portion 34 of the hutch downwardly to increase the volume of the hutch. This fairly steady negative pulse ends when the hutch reaches its maximum volume and the valve again opens to produce another sharp positive pulse like that shown at A. It should be noted that the curve of the actual flow of water, as opposed to the pressure wave, through the hutch is quite similar to the curve shown in FIG. 9, except that the peaks A and C are absent.

As shown in the drawings, the hopper portion 22 of the hutch is preferably provided with a hopper fluid inlet 23. This feature is standard in mining jigs. As with the inlet 54 into the drive chamber 52, the form of the hopper inlet 23 may be any of the various standard forms for water inlets. The hopper inlet 23 is preferably provided with a gate valve to control the amount of water admitted into the hopper 22. The amount of water admitted is one of the means of controlling the relative magnitudes of the pressure pulses.

Figure 6:
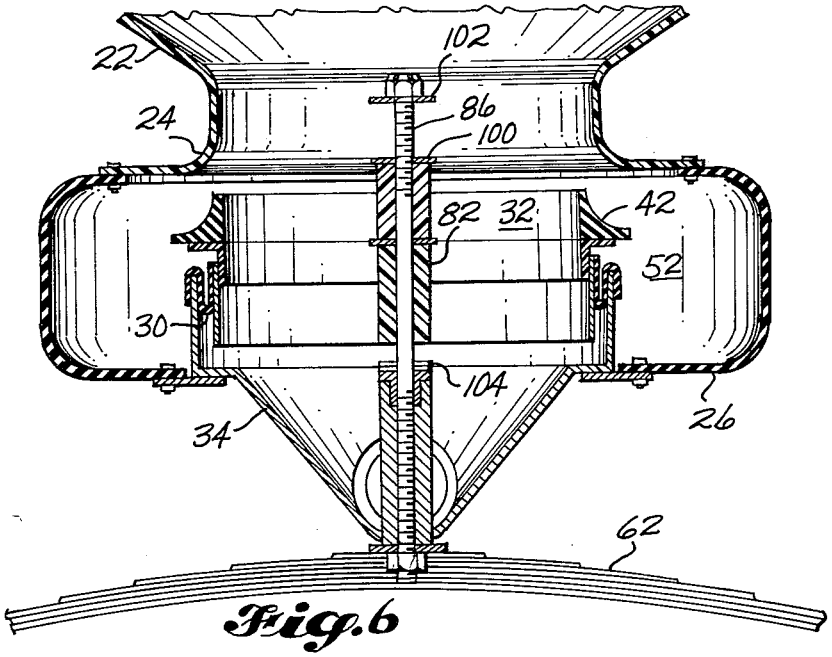
FIG. 6 is a fragmentary view through a modified form of transducer, showing a modified form of structure for connecting the valve plug of the drive chamber valve to the lower wall portion of the expansible hutch.
Figure 7:
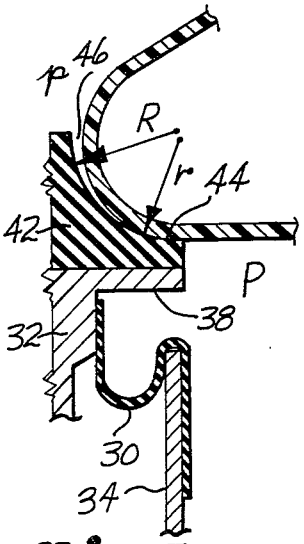
FIG. 7 is an enlarged scale fragmentary view, showing the parts in section, in the region of contact between the valve member and the valve seat, showing the valve in a closed position.
Figure 8:
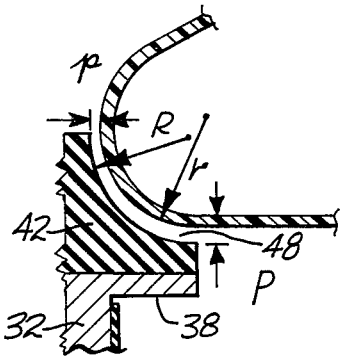
FIG. 8 is a view like FIG. 7, but showing the valve member in a slightly open position.

As described above, the lowest portion 54 of the hutch and the valve carrying portion 32 of the hutch move with respect to each other. This requires that the valve carrying member 32 be provided with separate mounting means. This mounting means comprises a hub 82 and spokes 84 extending radially between the hub 82 and the vertical cylindrical walls of the valve carrying body 32. The hub 82 has an axial passageway that receives a vertical rod 86. The vertical cylindrical walls, the hub 82, and the rod 86 are all essentially concentric. This mounting arrangement allows the annular seal 42 to remain seated against its seat when the hutch is expanding in volume. The mounting means includes a lost motion connection between the valve carrying body 32 and the bottom wall 35 of the hutch. This lost motion connection allows the lowest portion 34 of the hutch to move downwardly a predetermined amount to nearly its maximum extent of downward travel without causing the seal 42 to unseat. When the predetermined amount of downward travel has occurred, the lost motion connection positively connects the valve carrying body 32 with the bottom wall 35 of the hutch and additional downward movement of the bottom 34, 35 of the hutch causes the seal 42 to unseat. In FIGS. 2–4 and 10–13 one embodiment of the lost motion connection is shown. FIG. 6 shows an alternative embodiment of the lost motion connection.

In the embodiment shown in FIGS. 2–4 and 10–13, the lost motion connection includes a rod support 88 that is connected to the bottom wall 35 of the hutch and that has a rod receiving axial passageway extending therethrough. The rod 86 extends downwardly through both the axial passageway in the hub 82 and the axial passageway in the rod support 88. The rod 86 includes a projecting end portion 90 that projects downwardly and outwardly below the bottom 35 of the hutch and that has an end stop 92. The rod 86 is secured to the hub 82 by means of bolts 94 at the upper and lower ends of the hub 82. The rod 86 slides freely through the axial passageway in the rod support 88 that is connected to the bottom 35 of the hutch. Therefore, the rod 86 is free to move relative to the bottom 35 of the hutch, but not relative to the valve carrying body 32. A spring 96 is positiond around the projecting end 90 of the rod 86. The spring 96 is secured between the rod support 88 connected to the bottom 35 of the hutch and bolts fastened to the bottom of the rod 86. When the lowest portion 34 of the hutch moves downwardly, the spring 96 surrounding the projecting end 90 of the rod 86 compresses and the rod 86 moves relative to the lowest portion 34 of the hutch. When the spring 96 reaches its limit of compression, the rod support 88 engages the end stop 92 at the bottom of the rod 86 and the rod 86 is moved downwardly, thereby moving the valve carrying body 32 downwardly and unseating the seal 42. When the downward force on the lowest portion 34 of the hutch is removed, the spring 96 surrounding the projecting end 90 of the rod 86 helps to move the valve carrying body 32 upwardly to reengage the seal 42.

In the embodiment shown in FIG. 6, the rod 86 is secured to the bottom 35 of the hutch so that it may not move relative to the rod support 88 connected to the bottom 35 of the hutch. The rod 86 is secured by means of fastening members, such as nuts, positioned at the bottom and the top of the rod support 88. In this embodiment, the rod 86 moves relative to the hub 82, sliding freely through the axial passageway in the hub 82. The hub 82 carries an elastomer rubber bumper 100 surrounding the axial passageway. The top end of the rod 86 projects upwardly and outwardly out of the axial passageway through the hub 82 when the hutch is not in its maximum volume position. When the hutch reaches nearly its maximum volume, a flange 102 secured by a nut on the top end of the rod 86 engages the elastomer bumper 100 surrounding the axial passageway in the hub 82. This places a downward force on the valve carrying body 32 and unseats the seal 42. When the lowest portion 34 of the hutch begins its upward movement, a bumper 104 at the top end of the rod support 88 engages the lower surface of the valve carrying body 32 exerting an upward force on the valve carrying body 32 that tends to move the seal 42 into a seated position.

The second embodiment of the lost motion connection has certain advantages. These advantages include allowing greater ground clearance under the hutch and allowing better access to make adjustments to control the length of the stroke by adjusting the distance in which the rod 86 is free to travel. Another advantage is that the bumper 100 surrounding the axial passageway in the hub 82 may be manufactured from an elastomer that will be naturally lubricated by the water in the hutch, thereby preventing deterioration. In the first embodiment, the spring 96 beneath the hutch, even though manufactured from coated steel, is subject to a certain amount of corrosion.

The structure of the seal 42 and the seal seat themselves contributes significantly to the operation of the jig 2 incorporating the transducer. The valve seat formed by the upper annular wall 24 has a convex surface. The seal 42 carried by the valve carrying member 32 has a concave surface. The curvatures of the valve seat and the seal surface differ, with the radius of curvature of the seal surface being greater than the radius of curvature of the seat. As a result of this difference in curvature, when the seal 42 is seated against the seat, the seating contact with the valve seat is in an annular zone 44 adjacent to the drive chamber 52. There is an annular gap 46 between the seat and the seal 42 on the hutch side of the annular contact zone 44. This annular gap 46 widens from the region of sealing contact towards the hutch. This sealing arrangement functions to minimize leakage of the seal 42. Should leakage tend to occur from the drive chamber 52 into the hutch, the movement of higher pressure from the drive chamber 52 into the hutch tends to create a vacuum-like effect in the gap 46. This vacuum-like effect produces a lower pressure in the gp 46 then in the hutch. This lower pressure tends to automatically reseat the seal 42 because the relatively high pressure in the hutch, that is relative to the pressure in the gap 46, tends to push the outer surface of the end of the seal 42 inside the hutch towards its seat. The sealing engagement is also enhanced by the high pressure in the drive chamber 52 acting on the end of the seal that projects into the drive chamber 52 and tending to push this end of the seal 42 into contact with its seat. This action on the projecting end of the seal 42 in the drive chamber 52 also helps to seat the seal 42 when the hutch moves to its lowest volume position.

The difference in curvature of the seal 42 and the seat has an additional function when the valve carrying body 32 and the seal 42 are moved axially away from the valve seat. When this movement away from the valve seat reaches a predetermined amount, a gap 48 is formed between the seal 42 and the valve seat. Because of the shape of the surfaces and the direction of movement, this gap 48 tends to widen on the high pressure end of the seal 42, that is the end of the seal 42 projecting into the drive chamber 52, and to narrow at the low pressure end of the seal 42 in the hutch. In other words, the gap 48 that is formed when the seal 42 unseats is relatively wide adjacent to the drive chamber 52 and relatively narrow adjacent to the hutch. The high pressure from the drive chamber 52 moves into the gap 48 towards the hutch in which lower pressure conditions exist. This movement of pressure into the wedge-like shaped gap 48 tends to strongly push the seal 42 away from the seat. This helps to pop open the seal 42 and contributes to the functioning of the jig by increasing the sharpness of the positive pressure pulse entering the hutch.

As noted above, the initial cost of a mining jig incorporating a transducer of this invention is relatively low. The transducer may be constructed from a variety of materials. For example, the bottom portion 34 of the hutch and the valve carrying body 32 may conveniently be constructed from cast aluminum. The flexible diaphragm 26 that forms an important part of the drive chamber 52 may conveniently be constructed of material resembling an automobile tire. In fact, the transducer may be actually constructed utilizing an automobile tire.

It should be obvious to those skilled in the art that the transducer and valve structure of the present invention may be used to advantage in a variety of situations. Of course, different applications would require modifications in the details of structure of the transducer and/or valve. but such modifications may be made without departing from the spirit and scope of the present invention. Some other possible applications are fluidizing suspended particulates, underwater transducer applications, seismic prospecting, distance and/or direction finding, and pumping.

The following are typical control features of the transducer:

The supply of inlet water to the drive chamber 52 can be controlled. An increased rate of flow will increase the cyclic rate and increase negative pressure in the hutch. The tension of the leaf springs 62 can be adjusted. An increase in tension will decrease negative pressure in the hutch. It will also increase the pressure of the positive pulse and will shorten the duration of the positive pulse while increasing the duration of the negative pulse. The amount of lost motion in the control rod 86 can be adjusted. A decrease in the amount of lost motion will increase the cyclic rate. It will also decrease the magnitude of flow, both positive and negative. The hopper water inlet 23 can be regulated. An increase in flow will decrease negative pressure in the hutch and will also decrease negative flow from the screen 6. It will also increase the cyclic rate. The addition of an eductor can be used to increase negative pressure in the hutch and also increase negative flow from the screen 6.

The provision of a lost motion connection between the movable wall portion 34 of the hutch and the valve member 32 contributes a very valuable characteristic to the transducer and especially makes the transducer attractive for use in a mining jig. It is this feature which results in the creation of negative pressure or partial vacuum in the hutch prior to the rapid injection of the fluid pressure. In a mining jig installation, it is what results in a substantial improvement in the amount of fine particle removal from the material bed.

Although the best modes and preferred embodiments of the invention have been illustrated and described herein, it is intended to be realized by those skilled in the art that the present invention may be embodied in other than the specific apparatus and applications illustrated and described herein. Various changes may be made without departing from the spirit and scope of the present invention as defined in the following claims.

I claim:

1. A fluid powered transducer, comprising:

wall means defining an expansible chamber, movable between a minimum size position and a maximum size position;

return spring means normally biasing the expansible chamber into its minimum size position;

outlet means for said chamber, including check means for permitting outflow from said chamber when pressure in the chamber exceeds the pressure downstream of the chamber, and preventing backflow into the chamber when the pressure in the chamber is lower than the pressure downstream of the chamber;

means for positively driving the expansible chamber from its minimum size position to its maximum size position, and in the process storing energy in the return spring means; and means for delivering a burst of fluid pressure, attended by fluid flow and an acoustical wave, into said chamber when the chamber is substantially at its maximum size, and for removing the driving force on said expansible chamber substantially simultaneously with the introduction of the burst of fluid pressure, to permit the return spring means to move the expansible chamber from its maximum size position back into its minimum size position, said means for delivering and removing including valve means that opens to deliver said burst of fluid pressure and fluid flow and closes substantially when the chamber reaches its minimum size.

2. A fluid powered transducer, comprising:

wall means defining an expansible chamber having a movable end wall and an annular sidewall which includes a fixed first portion and a flexible, movable second portion interconnected between said end wall and the fixed first portion;

an annular valve seat carried by the fixed first portion of the sidewall means;

an annular valve member having a sealing surface directed towards the valve seat;

means connecting the annular valve member to the movable end wall, including an annular flexible wall which will flex to permit movement of the valve member towards and away from the end wall;

wherein the valve member, a portion of the end wall, the flexible second portion of the sidewall, and the means connecting the valve member to the end wall together define an annular drive chamber which is a closed chamber when the valve member is seated;

means for delivering a fluid into said annular drive chamber, for pressurizing said drive chamber and for moving the end wall away from the fixed first portion of the sidewall, to in that manner expand the expansible chamber;

wherein the flexible second portion of said sidewall flexes during such end wall movement and expansible chamber expansion;

outlet means for said expansible chamber, including check means for permitting outflow from said expansible chamber when pressure in the expansible chamber exceeds the pressure downstream of the expansible chamber, and preventing backflow into the expansible chamber when the pressure in the expansible chamber is lower than the pressure downstream of the expansible chamber;

mounting means for the valve member which permits the valve member to stay seated against the valve seat as the end wall of the expansible chamber moves in an expanding direction, said mounting means including a lost motion connection between the valve member and the end wall which functions to permit a predetermined amount of expansion movement of the end wall away from the valve member and, following such predetermined amount of expansion movement of the end wall, positively connects the valve member with the end wall so that additional movement of the end wall will cause the valve member to move with the end wall, in a valve opening direction, at which time a burst of fluid pressure attended by fluid flow and an acoustical wave will be delivered from said drive chamber into the expansible chamber; and return spring means bearing against the end wall of the expansible chamber and normally biasing the end wall towards its minimum size position, wherein energy is stored into said return spring means as the end wall is moved by fluid pressure within the drive chamber, said return spring means functioning to both move the end wall in a chamber contracting direction and to return the valve member to its seated position substantially immediately following opening of the valve means.

3. A fluid powered transducer according to claim 2, wherein one of said annular valve seat and said sealing surface is axially convex and the other is axially concave, and wherein the curvature of each surface is different and when the valve member is seated its sealing surface makes seating contact with the valve seat in an annular zone adjacent the drive chamber and an annular gap is created between the valve seat and the sealing surface on the expansible chamber side of the annular contact zone.

4. A fluid powered transducer according to claim 2, wherein the mounting means for the valve member comprises a hub and spokes extending radially between the hub and the annular valve member, said hub including a rod receiving axial passageway; and said lost motion connection comprises a rod support connected to the end wall of the expansible chamber having a rod receiving axial passageway, and a rod extending through both the passageway in the hub and the passageway in said rod support, said rod including a projecting end portion with an end stop, and means connecting the rod to one of said hub and rod support, with the rod being free to move relatively through the other until contact is made with the end stop.

5. In a mining jig of a type having a bed screen that supports ragging and material containing minerals to be worked on, a transducer comprising:

wall means defining an expansible hutch chamber, at least a portion of which is in use positioned below the bed screen, said hutch chamber having an outer portion which is movable towards the away from the bed screen;

return spring means normally biasing the outer portion of said chamber inwardly;

outlet means for said hutch chamber including check means for permitting outflow from said hutch chamber when pressure in said hutch chamber exceeds the pressure downstream of the hutch chamber and preventing backflow into said hutch chamber when the pressure in the hutch chamber is lower than the pressure downstream of the hutch chamber;

means for driving the outer portion of said hutch chamber outwardly, to store energy in said return spring means and increase the volume of said hutch chamber; and means for delivering a burst of fluid pressure into said hutch chamber, attended by fluid flow and an acoustical wave, when the hutch chamber is substantially at its maximum size and for removing the outward force on the outer portion of said hutch chamber substantially simultaneously with the introduction of the burst of fluid pressure, permitting the return spring means to move the outer portion of said hutch chamber inwardly towards the bed screen and return the hutch chamber to its minimum size; said means for delivering and for removing including valve means that opens to deliver said burst of fluid pressure and fluid flow and closes substantially when the hutch chamber reaches its minimum size.

6. A transducer as described in claim 5, in which the means for delivering a burst of fluid pressure, and the means for driving the expansible hutch chamber from its minimum size to its maximum size, comprise annular wall means that includes a flexible wall portion that, with outer portions of the wall means that defines the expansible hutch chamber, forms an expansible annular drive chamber surrounding the expansible hutch chamber, said valve means being positioned between the annular drive chamber and the hutch chamber; and inlet means for introducing fluid pressure into the annular drive chamber to expand said annular drive chamber.

7. A transducer as described in claim 6, in which:

said annular wall means has an annular inner portion that extends substantially radially outwardly from the wall means defining the hutch chamber inwardly of said outer portion of the hutch chamber, and an annular outer portion that extends rigidly and substantially radially outwardly from said wall means defining the hutch chamber adjacent to said outer portion of the hutch chamber;

and the means for driving the outer portion of the hutch chamber outwardly comprises a pressure surface formed by said annular outer portion of the annular wall means, said pressure surface being acted upon by the fluid pressure admitted into said annular drive chamber with such fluid exerting an outward force on the wall means defining the hutch chamber via the pressure surface to increase the volume of the hutch chamber.

8. A transducer as described in claim 7, in which:

said wall means defining the hutch chamber includes a first upper portion, and a second lower portion that defines said outer portion of the hutch chamber and that is spaced vertically below said first upper portion; said second lower portion including a vertically flexible wall portion, and an upper end wall; and said valve means comprises an essentially annular seal that is carried by said upper end wall and that seats against said annular upper portion of said annular wall means.

9. A transducer as described in claim 5, in which the outlet means includes an opening at the outer end of the hutch chamber, and tubing extending outwardly from said opening; and the check means comprises a check valve positioned in said tubing.

10. A transducer as described in claim 5, in which the return spring means comprises at least one leaf spring having a central portion that is urged against a bottom surface of the wall means defining the hutch chamber.

11. A transducer as described in claim 10:

further comprising a frame having a rigid bottom wall, and sidewalls that surround the hutch chamber; and in which each end of said leaf spring is suspended from an upper portion of said sidewalls to isolate vibrations originating in the hutch chamber.

12. A valve for use between a high pressure first chamber and a low pressure second chamber, comprising:

means defining an annular valve seat; and a valve member movable axially towards and away from said valve seat, said valve member including an annular sealing surface, wherein one of said valve seat and said sealing surface is convex in the axial direction and the other is concave in the axial direction, wherein the curvature of the valve seat differs from the curvature of the sealing surface such that when the valve member is seated an annular zone of contact exists between the sealing surface and the valve seat and an annular gap exists between the valve seat and the sealing surface on the low pressure side of the valve and said gap widens from the region of sealing contact towards the low pressure chamber when the valve member is seated, and wherein after the valve member has been moved axially away from the valve seat a predetermined amount a gap is formed between the sealing surface and the valve seat which narrows from the high pressure chamber to the low pressure chamber.

13. A valve according to claim 12, wherein the valve seat is convex, the sealing surface is concave, and the radius of curvature of the sealing surface is larger than the radius of curvature of the valve seat.

14. A method of generating wave energy, comprising:

expanding an expansible chamber and in so doing reducing the pressure within said chamber;

following expansion of said expansible chamber a predetermined amount, delivering a burst of fluid pressure, attended by fluid flow and an acoustical wave, into said expansible chamber; and substantially simultaneously with the introduction of the burst of fluid pressure into the expansible chamber, forcibly contracting the expansible chamber, with said expansible chamber in open communication with an adjoining region.

15. A method according to claim 14, comprising introducing said burst of fluid pressure into said expansible chamber through an annular opening which surrounds a portion of the expansible chamber.

16. A method according to claim 15, comprising closing said annular opening by use of a valve, developing fluid pressure on the side of said valve opposite the expansible chamber, and then opening said valve following expansion of such chamber by said predetermined amount to in that manner deliver the burst of fluid pressure through said annular opening.

17. A method according to claim 16, comprising expanding said expansible chamber by moving a first end portion of said chamber relative to an opposite end portion, and utilizing movement of said first chamber portion to pull said valve open during movement of said first chamber portion beyond said predetermined amount.

18. A method according to claim 17, comprising contracting the expansible chamber by forcibly driving the movable first end portion of the chamber towards the opposite end portion of the chamber and using such movement to assist closing of the valve.

* * * * *